US009387379B1

(12) United States Patent
Sanyal et al.

(10) Patent No.: US 9,387,379 B1
(45) Date of Patent: Jul. 12, 2016

(54) REVERSIBLE GOLF CLUB GRIP

(71) Applicant: Brainstorm Golf, Inc., Escondido, CA (US)

(72) Inventors: Vikash Sanyal, Valley Center, CA (US); David Stuart Cooper, Encinitas, CA (US); Jeffrey D. Sheets, Buda, TX (US)

(73) Assignee: BRAINSTORM GOLF, INC.

( * ) Notice: Subject to any disclaimer, the term of this patent is extended or adjusted under 35 U.S.C. 154(b) by 0 days.

(21) Appl. No.: 14/716,758

(22) Filed: May 19, 2015

Related U.S. Application Data

(60) Provisional application No. 62/001,499, filed on May 21, 2014.

(51) Int. Cl.
*A63B 53/14* (2015.01)

(52) U.S. Cl.
CPC ..... *A63B 53/14* (2013.01)

(58) Field of Classification Search
CPC ..... A63B 53/14; A63B 60/06; A63B 60/14; A63B 60/20; A63B 60/24; A63B 60/26; A63B 60/28
See application file for complete search history.

(56) References Cited

U.S. PATENT DOCUMENTS 4,426,083 A * 1/1984 Dishner, Jr. ..... A63B 53/007 473/252
4,537,403 A * 8/1985 Farina ..... A63B 53/007 473/203
4,629,191 A * 12/1986 Mancuso ..... A63B 53/14 473/203
4,735,414 A * 4/1988 Williams ..... A63B 53/065 473/248
5,169,152 A * 12/1992 Marquardt ..... A63B 53/14 473/201
5,253,869 A * 10/1993 Dingle ..... A63B 53/02 473/245
5,390,919 A * 2/1995 Stubbs ..... A63B 53/065 473/246
5,398,934 A * 3/1995 Soong ..... A63B 53/14 473/299
5,779,559 A * 7/1998 Eberle ..... A63B 53/14 473/252
5,855,525 A * 1/1999 Turner ..... A63B 53/14 473/300
6,251,027 B1 * 6/2001 Buchanan ..... A63B 53/007 473/300
6,435,976 B1 * 8/2002 Galliers ..... A63B 53/02 473/244
6,843,732 B1 * 1/2005 Huang ..... A63B 53/14 473/300
6,988,295 B2 * 1/2006 Tillim ..... A61B 17/2909 16/110.1
6,988,958 B2 * 1/2006 Roelke ..... A63B 53/14 473/295

(Continued)

FOREIGN PATENT DOCUMENTS

JP 09099123 A * 4/1997

*Primary Examiner* — Stephen Blau
(74) *Attorney, Agent, or Firm* — Cooley LLP

(57) ABSTRACT

In some embodiments, a golf club includes a reversible grip that that is universal to dexterity and can be used on a golf club configured for both right-handed golfers and left-handed golfers. Such a reversible golf club grip can provide the golf club with an identical grip configuration without removing the grip from the shaft of the golf club. In some embodiments, a reversible golf club grip as described herein can be used on an adjustable golf club such that as the orientation of the golf club shaft is reversed between a right-handed and left-handed dexterity, the grip can be used for either orientation without being repositioned on the shaft. In some embodiments, a reversible golf club grip can be configured to promote a traditional hands placement on the golf club grip in both right-handed and left-handed orientations.

13 Claims, 8 Drawing Sheets

(56) References Cited

U.S. PATENT DOCUMENTS

| | | | | |
|---|---|---|---|---|
| 8,241,138 | B2 * | 8/2012 | Maglaque | A63B 69/3617 473/201 |
| 8,845,448 | B2 * | 9/2014 | Huang | A63B 53/14 473/300 |
| 8,932,146 | B2 * | 1/2015 | Chu | A63B 53/14 473/201 |
| 2006/0068929 | A1 * | 3/2006 | Goldfader | A63B 69/3685 473/294 |
| 2006/0156514 | A1 * | 7/2006 | Lewis | A45F 5/102 16/426 |
| 2007/0123364 | A1 * | 5/2007 | Solari | A63B 53/14 473/201 |
| 2009/0258721 | A1 * | 10/2009 | Huang | A63B 53/14 473/300 |
| 2013/0109491 | A1 * | 5/2013 | Solheim | A63B 53/00 473/296 |
| 2013/0130825 | A1 * | 5/2013 | McLoughlin | A63B 53/14 473/303 |
| 2014/0076487 | A1 * | 3/2014 | Su | B25G 1/10 156/245 |
| 2015/0265890 | A1 * | 9/2015 | Presse, IV | A63B 53/00 473/300 |

* cited by examiner

REVERSIBLE GOLF CLUB GRIP

CROSS-REFERENCE TO RELATED APPLICATIONS

The present application claims the benefit of priority under 35 U.S.C. §119(e) of U.S. Provisional Application Ser. No. 62/001,499, entitled REVERSIBLE GOLF CLUB GRIP, filed May 21, 2014, the contents of which is hereby incorporated by reference in its entirety for all purposes.

BACKGROUND

The systems and apparatus of the disclosure relate to reversible golf club grips. In particular, but not by way of limitation, the present disclosure relates to golf club grips that are universal to dexterity and can be used by both right-handed golfers and left-handed golfers.

Each individual golfer is different, being of differing dexterity (e.g., right handed, left handed), different strength, differing size, and having different golf club strokes. Modern golf club grips are fitted to match a golfer's specific dexterity (e.g., right handed grip, left handed grip) and are typically not reversible to the dexterity of the golfer. Some known golf club grips have been designed with some adaptability with respect to dexterity. However, these adaptable golf club grips can be very complex to build and can also be expensive and require a new gripping style upon a change of adaptation.

Accordingly, a need exists for golf club grips that are universal to dexterity and can be used by both right-handed and left-handed golfers when the golf shaft is reversed from one dexterity to another.

SUMMARY

Exemplary embodiments of the teachings disclosed herein are shown in the drawings that are summarized below. These and other embodiments are more fully described in the Detailed Description section. It is to be understood, however, that there is no intention to limit the invention to the forms described in this Summary or in the Detailed Description. One skilled in the art can recognize that there are numerous modifications, equivalents and alternative constructions that fall within the spirit and scope of the disclosed teachings.

In some embodiments, a golf club grip is provided that can be coupled to a shaft of a golf club (e.g., a putter) that is configured for use by either or left-handed or right-handed golfer. Such a golf club grip can have a geometry that promotes a traditional hands placement on the golf club grip in both right-handed and left-handed orientations.

In some embodiments, a golf club includes a reversible grip that that is universal to dexterity and can be used on a golf club configured for both right-handed golfers and left-handed golfers. Such a reversible golf club grip can provide the golf club with an identical grip configuration without removing the grip from the shaft of the golf club. In some embodiments, a reversible golf club grip as described herein can be used on an adjustable golf club such that as the orientation of the golf club shaft is reversed between a right-handed and left-handed dexterity, the grip can be used for either orientation without being repositioned on the shaft. In some embodiments, a reversible golf club grip can be configured to promote a traditional hands placement on the golf club grip in both right-handed and left-handed orientations.

In one embodiment the disclosure relates to a reversible golf club grip including an elongate base member. The elongate base member defines an interior channel extending from a top end portion to a bottom end portion and further defines a substantially planar front surface and a substantially planar rear surface separated by a vertical dimension. Opposing radial surfaces separated by a horizontal dimension perpendicular to the vertical dimension are also defined by the elongate base member, the vertical dimension being greater than the horizontal dimension. The reversible golf grip may also include an outer wrap member circumscribing and coupled to the elongate base member.

In a particular embodiment the horizontal dimension is associated with radii of the opposing radial surfaces wherein each of the opposing radial surfaces extends between an edge of the substantially planar front surface and an edge of the substantially planar rear surface. The radii may include a first radius associated with a first curved surface of the opposing radial surfaces and a second radius associated with a second curved surface of the opposing radial surfaces, the first radius being equal to the second radius.

In one aspect the outer wrap member may include alignment markings. In one embodiment the outer wrap member is coupled to the elongate base member such that a first set of the alignment markings, when viewed by a left-handed player, appear identical to a second set of the alignment markings when viewed by a right-handed player.

In another aspect the substantially planar front surface may define a fore panel and the substantially planar rear surface may define an aft panel identical and parallel to the fore panel.

The disclosure also pertains to a reversible golf club grip including an elongate base member defining an interior channel extending from a top end portion to a bottom end portion. The elongate base member further defines a substantially planar front surface and a substantially planar rear surface separated by a vertical dimension. Opposing curved surfaces separated by a horizontal dimension perpendicular to the vertical dimension are also defined by the elongate base member, wherein the vertical dimension is greater than the horizontal dimension. The bottom end portion may define an opening for receiving a shaft of a golf club.

As previously stated, the above-described embodiments and implementations are for illustration purposes only. Numerous other embodiments, implementations, and details of the invention are easily recognized by those of skill in the art from the following descriptions and drawings.

BRIEF DESCRIPTION OF THE DRAWINGS

Various objects and advantages and a more complete understanding of the present disclosure and teachings herein are apparent and more readily appreciated by reference to the following Detailed Description when taken in conjunction with the accompanying drawings wherein.

DETAILED DESCRIPTION

The present disclosure describes reversible golf club grips that are universal to dexterity and can be used by both right-handed golfers and left-handed golfers. Such reversible golf club (e.g., putter) grips can be installed (or fitted) on a shaft (or handle) of a golf club adapted for a specific dexterity (i.e., right handed golf club). In some embodiments, a reversible golf club grip described herein can be used on a golf club adapted to be adjustable for use by a left-handed or right-handed golfer, as described in more detail below. For example, in such an adjustable golf club, the hosel of the golf club can be positioned in a first orientation for a right-handed golfer and then reversed 180 degrees to be in the opposite dexterity for a left-handed golfer. In either position, the reversible golf club grip will be presented to the user with the same appearance and grip geometry.

In some embodiments, the reversible golf club grip can also incorporate or be bonded with a vibration dampening polyurethane sheet to contribute to smooth performance. Although embodiments herein describe the reversible golf club grip primarily in relation to a putter, it should be understood the reversible golf club grip described herein can be applied or incorporated within other types of golf clubs. For example, a reversible golf club grip as described herein can be incorporated with an adjustable golf club as described in U.S. patent application Ser. No. 14/216,973, entitled "Golf Club Configured for Multiple Adjustability", filed on Mar. 17, 2014 (the '973 application), and U.S. patent application Ser. No. 14/216,979, entitled "Adjustable Golf Club", filed on Mar. 17, 2014 (the '979 application), the disclosures of which are incorporated herein by reference in their entirety.

Figure 1A:
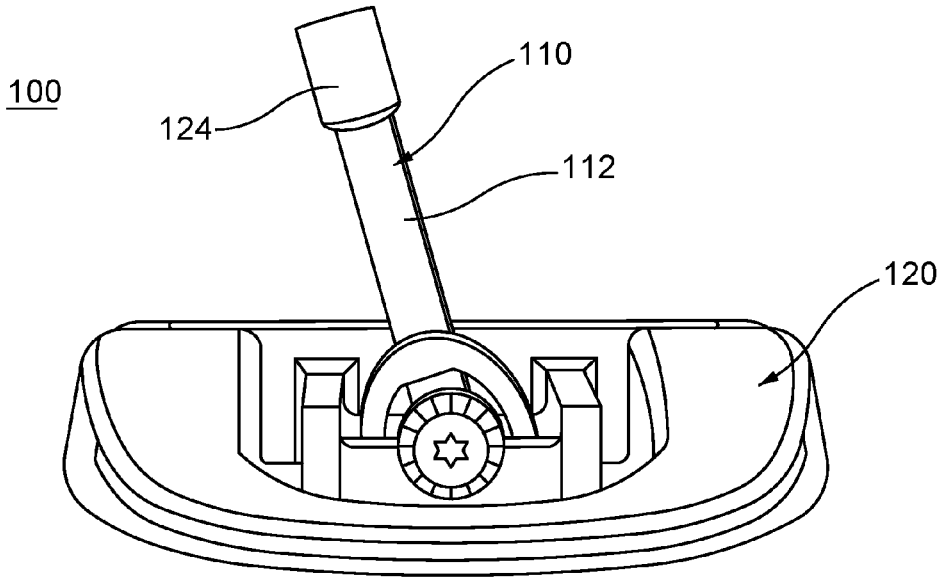
FIGS. 1A and 1B are a rear view and a partially exploded rear perspective view, respectively, of a body and hosel of a golf club according to an embodiment, shown configured for a right-handed user.
Figure 1B:
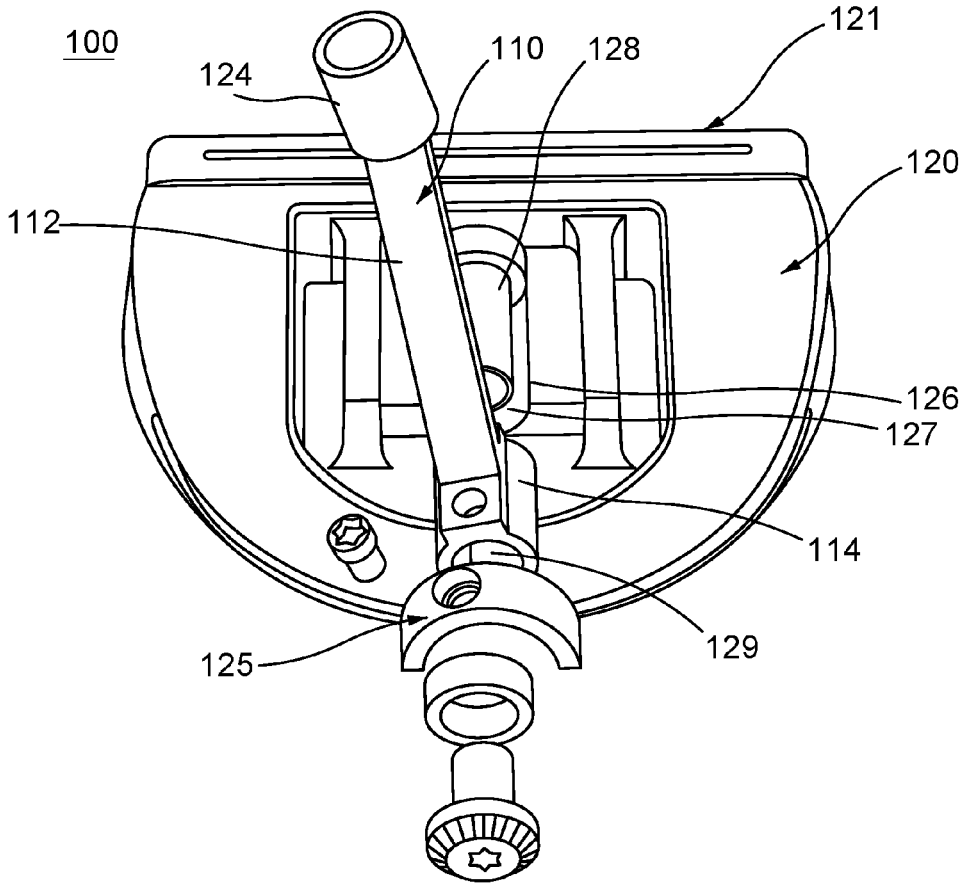

FIGS. 1A and 1B show a rear view and a partially exploded rear perspective view of a club body and hosel of a golf club configured for a right-handed golfer. A golf club 100 can be any type of golf club (e.g., a putter) and can include a club body 120 (also referred to as "body") including a face 121 for striking a golf ball and a hosel 110 including a hosel neck 112 and a hosel adapter 114. The hosel adapter 114 is configured to be coupled to the club body 120. For example, the hosel adapter 114 can be received within a hosel chamber 127 defined by a hosel housing 126 of the body 120 (see, e.g., FIG. 1B), as described for example in the '973 application. The hosel adapter 114 can define an interior channel 129 that can receive a hosel column 128 of the body 120 therethrough. A selected shim 125 can be used to position the hosel 110 at various angles relative to the body and to orient the golf club 100 for use by a left-handed or right-handed user, as described for example, in detail in the '973 application and the '979 application.

Figure 2A:
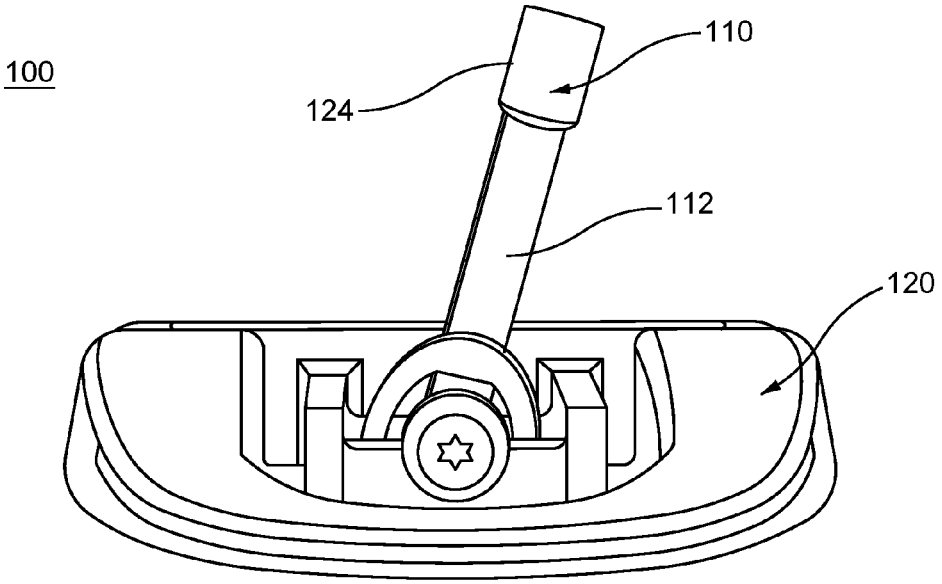
FIGS. 2A and 2B are a rear view and a partially exploded rear perspective view of the body and hosel of the golf club of FIGS. 1A and 1B, shown configured for a left-handed user.
Figure 2B:
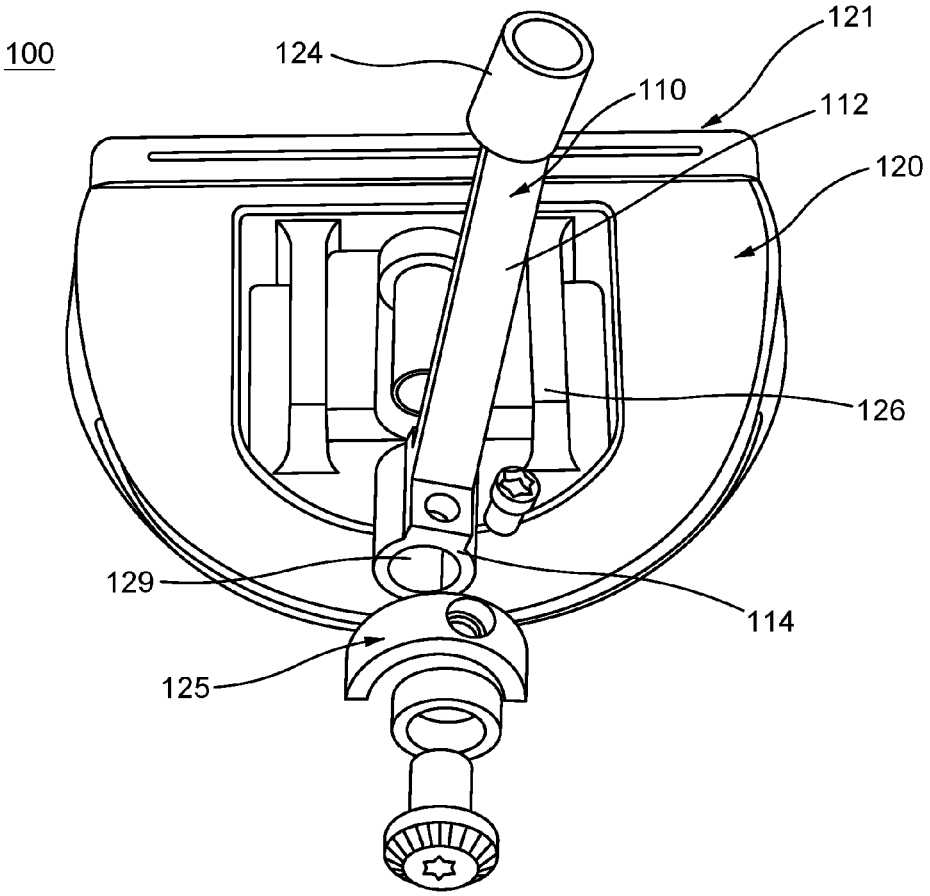

FIGS. 1A and 1B illustrate the golf club 100 with a shim 125 configured to orient or position the golf club 100 for a right handed user ad a specific lie angle. FIGS. 2A and 2B illustrate the golf club 100 with the shim 125 positioned for a left handed user. Although not shown, the golf club 100 includes a shaft coupled to the hosel 110 and the shaft can include a reversible golf club grip as described herein. For example, the shaft can be coupled to a shaft adapter 124 of the hosel 110. Specifically, a first end of the shaft can be coupled to the shaft adapter 124 and a reversible grip as described herein can be coupled to a second opposite end of the shaft.

A golf club grip as described herein can be coupled to a shaft of a golf club that is configured for either a left-handed or right-handed user. Hence, in the case of an adjustable golf club as described above and as described in the '973 application and the '979 application, the reversible grip can be used on the golf club 100 when the hosel 110 is positioned or configured for both a left-handed and a right-handed user. The reversible golf club grips described herein can also be installed on both right-handed and left-handed golf clubs that are not adjustable. Thus, the same golf club grip can be manufactured on both right-handed and left-handed golf clubs, reducing the cost of manufacturing two separate golf club grips for left and right-handed golf clubs. Additionally, such reversible golf club grips can promote traditional gripping techniques upon change of dexterity as compared to known grips that require a new gripping style upon adaptation to a new dexterity (e.g., wider style grips promoting the parallel thumbs method).

Figure 3:
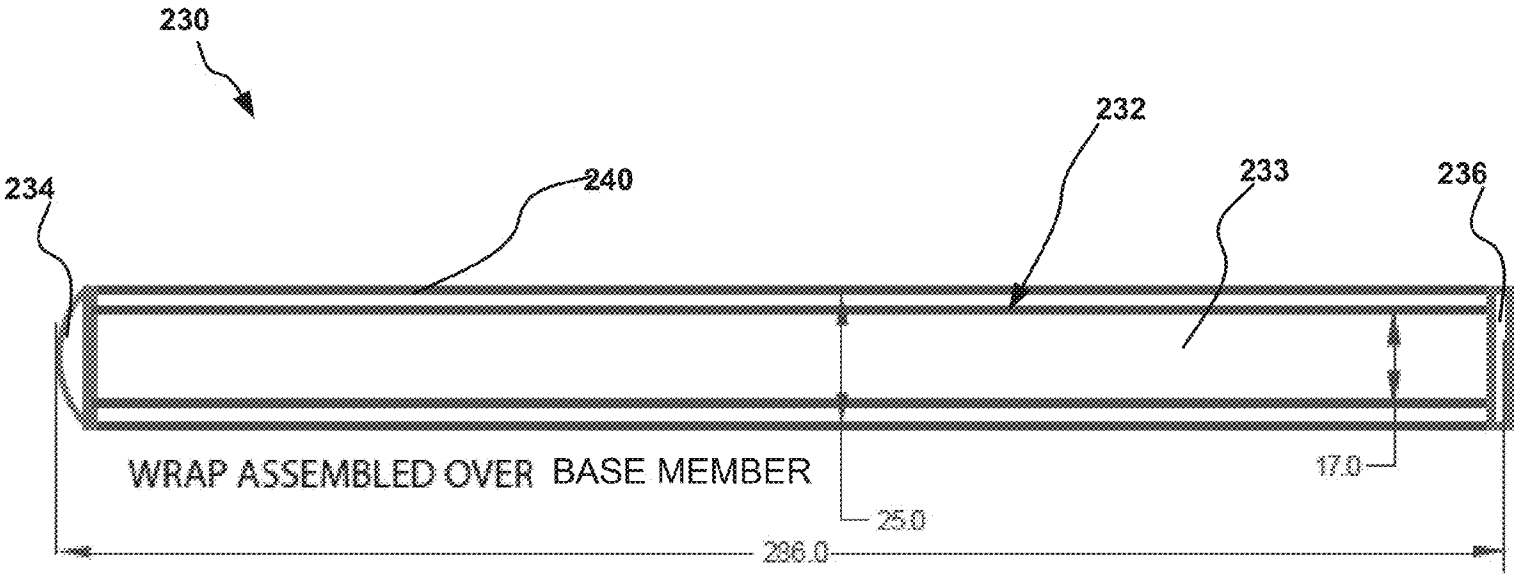
FIG. 3 is a side view of a reversible golf club grip, according to an embodiment.

FIG. 3 is a side cross-sectional view of a reversible golf club grip according to an embodiment. A reversible golf club grip 230 (also referred to as "grip" or "golf club grip" or "reversible grip") includes an elongate base member 232 and an outer wrap member 240 (also referred to as a "wrap"). As shown in FIGS. 4A-4E, the elongate base member 232 defines an interior channel 233 that extends from a top end portion 234 to a bottom end portion 236. The base member 232 also defines an opening 238 at the bottom end portion 234 through which a shaft of a golf club can be received and an opening 239 at the top end portion 234, each of which is in fluid communication with the channel 233 of the base member 232. The grip 230 can be coupled to a shaft of a golf club by, for example, sliding the base member 232 onto the shaft of the golf club.

Figures 4A, 4B, 4C:
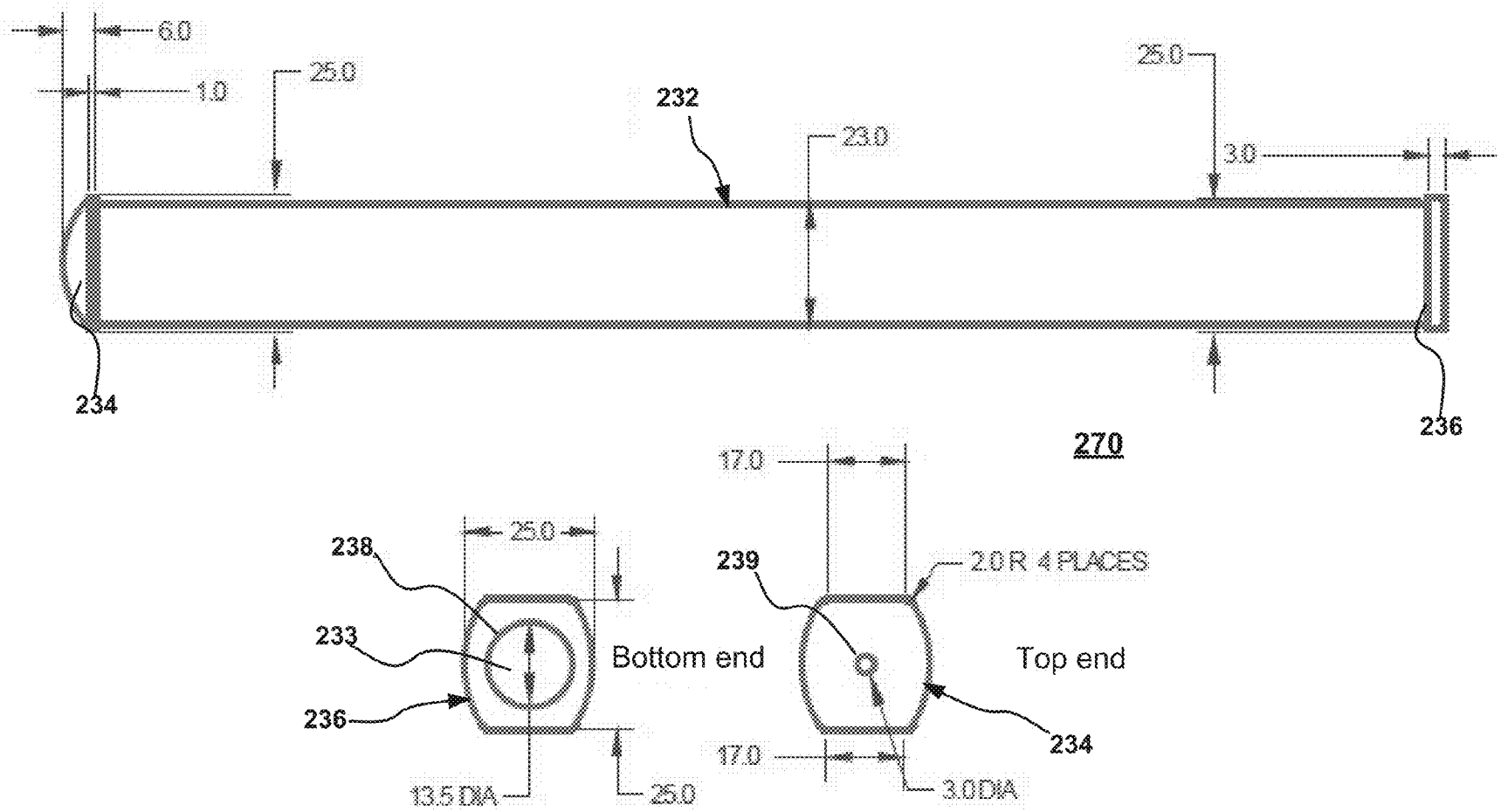
FIG. 4A is a side view of a base member of the reversible golf club grip of FIG. 3.
FIG. 4B is a bottom end view and FIG. 4C is a top end view of the base member of FIG. 4A.
Figure 4E:
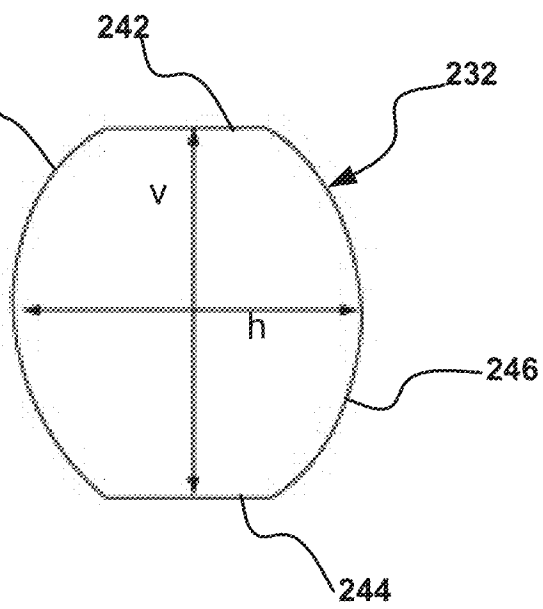
FIG. 4D is a cross-sectional view and FIG. 4E is a top end view of the base member of FIG. 4A.
Figure 4D:
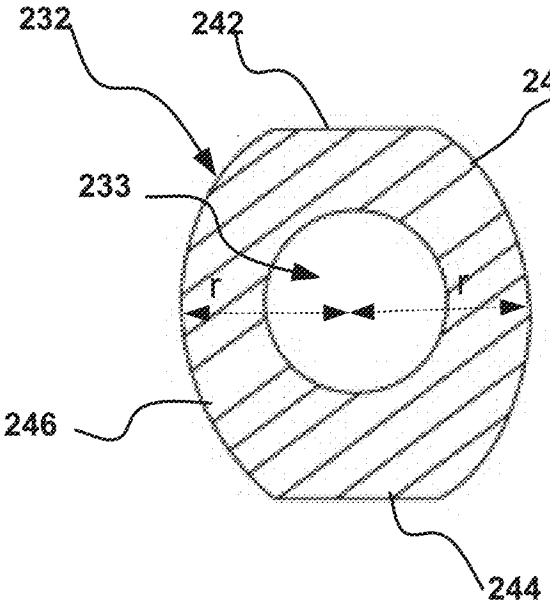

As shown, for example, in FIGS. 4D and 4E, the base member 232 of the grip 230 defines a vertical dimension, a horizontal dimension and a radius in a cross-sectional or end view of the grip 230. As shown in the top end view of FIG. 4E (FIG. 4E is shown without the opening 239), the vertical dimension 236 of the base member 232 is represented by "v" in FIG. 4E and the horizontal dimension is represented by "h" in FIG. 4E. FIG. 4D shows a cross-sectional view of the base member 232 and shows a radius of the curved portion of the base member 232

In some embodiments, the base member 232 can have a larger vertical dimension than a horizontal dimensional to promote a traditional gripping method. This is in contrast to a typical known round style golf club grip. Such an embodiment of a reversible golf club grip can promote a traditional grip of a golfer for either a right-handed or left-handed golfer. For example, in an adjustable golf club as described above, the grip 230 can be used when the shaft of the golf club is changed for use by a right-handed user and for a left-handed user (see, e.g., FIGS. 1A-2B). Hence, such a design promotes a golfer's traditional hand set up in the golfer's grip geometry and allows the reversible geometry to work for left-handed golfers and right-handed golfers without the reversible golf club grip being removed from the shaft of the golf club. As shown, for example, in FIGS. 4D and 4E, the reversible golf club grip 230 includes a radius "r" defined from a first side surface 246 or a second side surface 248 of the reversible golf club grip 230, a flat front surface 242 and a flat rear surface 244. With cylindrical sides and identical flat front (fore) and rear (aft) surfaces, the reversible golf club grip 230, can be installed on the shaft of the golf club in only one of two positions.

Figure 5:
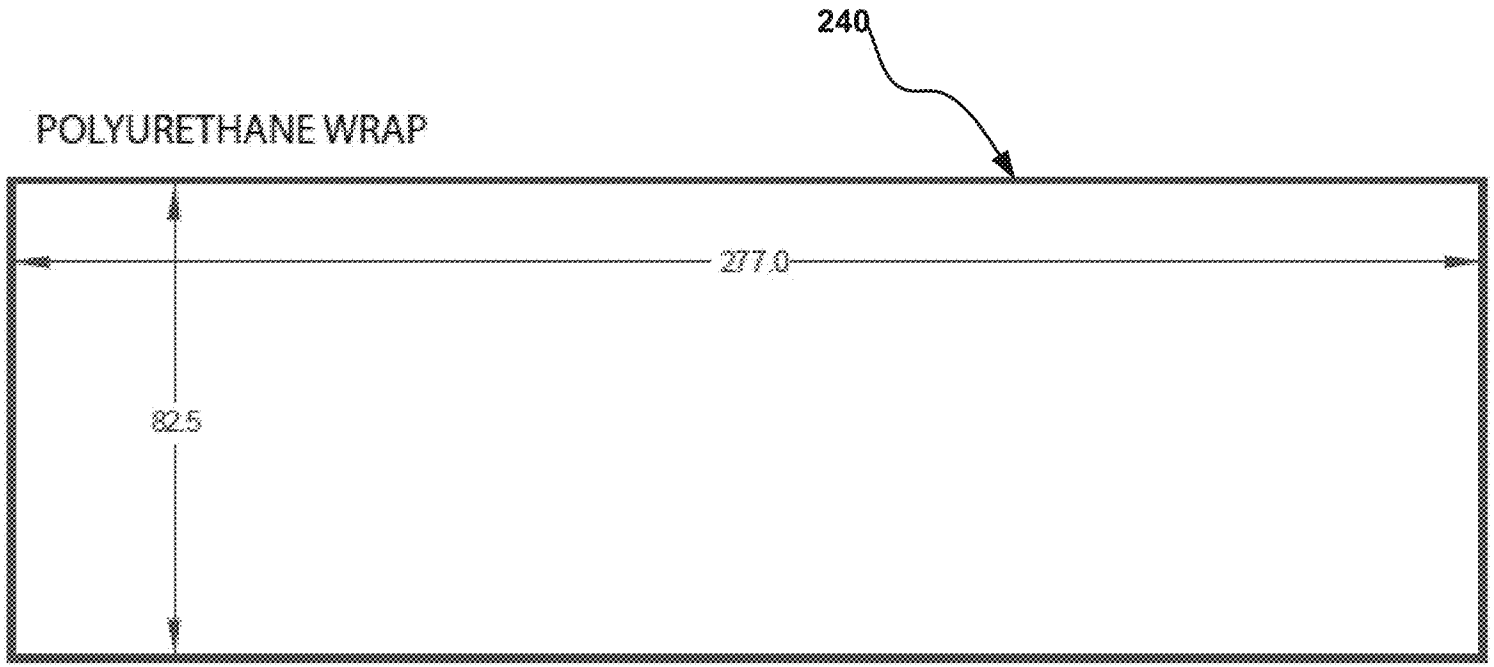
FIG. 5 is a top view of an outer wrap member of the reversible golf club grip of FIG. 3.

FIG. 5 is a top view of an outer wrap member 240, according to an embodiment. The outer wrap member 240 can be formed with a sheet of, for example, a polyurethane material. As shown in FIG. 3, the outer wrap member 240 can be wrapped around the base member 230 to provide a comfortable grip to a user. In some embodiments, the outer wrap member 240 can be adhesively bonded to the base member 232. In some embodiments, the outer wrap member 240 can define a resilient strip that can absorb shocks during impact with a golf ball and thus contribute to smooth performance of the golf club. Such a shock generated by impact between a golf club and a golf ball can adversely affect the muscle tissue and the arm joints of a golfer. The energy generated by such an impact is usually of high frequency and short duration with rapid decay that is often known as "impact shock." Typically, tight grasping of a golf club grip to keep from slipping in a golfer's hands during impact contributes to such impact shock. Hence, the increased resilience of the reversible golf club grip provided by the outer wrap member (e.g., the polyurethane sheet) can substantially reduce or even eliminate impact shock to the muscle and arm joint of the golfer.

Figure 6A:
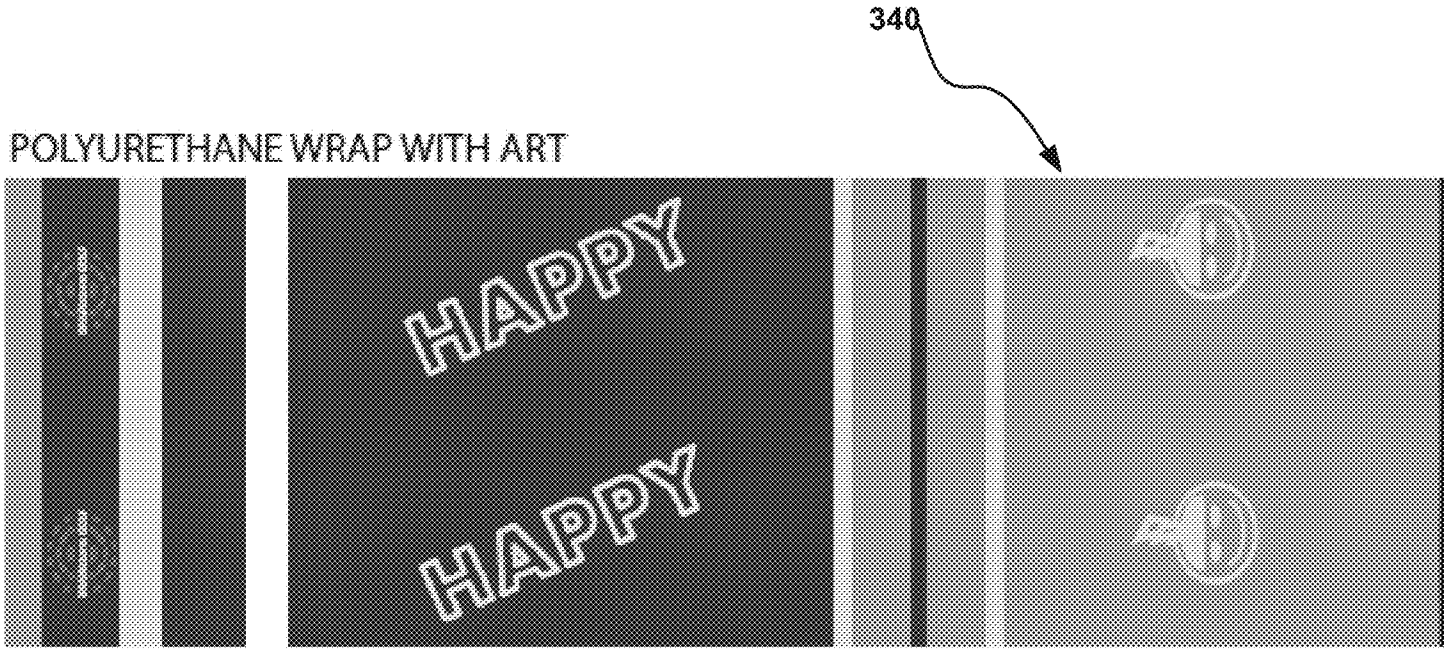
FIG. 6A is a tip view of another embodiment of an outer wrap member.
Figure 6B:
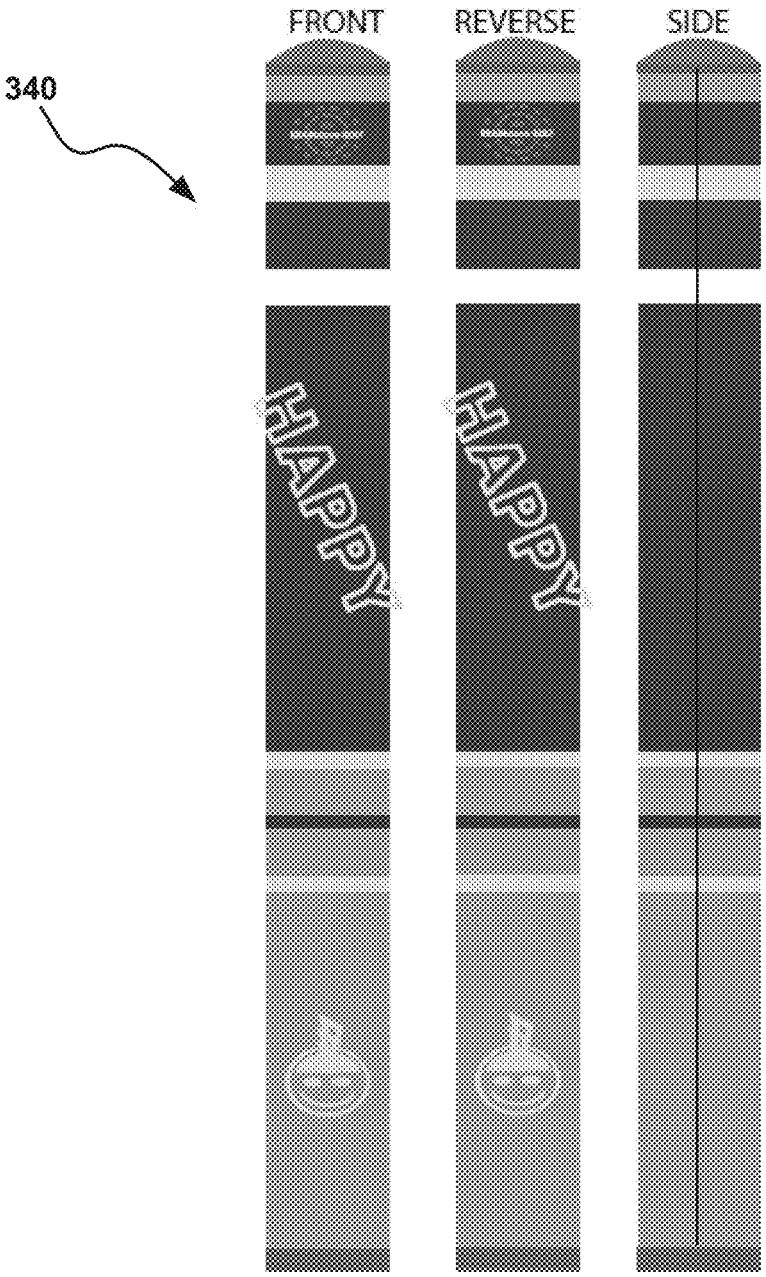
FIG. 6B illustrates a front view, rear view and side view of the outer wrap member of FIG. 6A shown as coupled to a base member of a reversible golf club grip.

FIGS. 6A-6B illustrate another embodiment of an outer wrap member that can be included on a reversible golf club grip as described herein. The outer wrap member 340 can be formed the same as or similar to the outer wrap member 240 and cab be coupled to (e.g., bonded) to a base member (e.g., base member 230) as described above. For example, FIG. 6B illustrates a front view, a rear view and a side view of the outer wrap member 340 coupled to (e.g., wrapped around and bonded) a base member (not shown). In this embodiment, the outer wrap member 340 includes graphics such as text, artwork, markings, lines, etc. For example, in some embodiments, alignment marking can be provided. In some embodiments, the graphics can be configured to have identical markings when the grip is oriented for a right-handed user and a left-handed user to help, for example, aid the golfer with placement of the golfer's hands.

The reversible golf club grips described herein can be incorporated on a variety of different types of golf clubs (e.g., putters, irons), and be used on golf clubs configured for either a right-handed or left-handed golfer. Such a reversible golf club grip can provide the same club grip for both left-handed and right-handed use, without the grip being removed from the shaft. For example, for an adjustable golf club as described above, the orientation of the golf club shaft can be reversed between right-handed and left-handed dexterity and the grip can be used for both orientations without removing and reinstalling the golf club. In some embodiments, a reversible golf club grip as described herein can have a geometry that can promote traditional hands placement on the golf club grip in both right-handed and left-handed orientations. Additionally, such a reversible golf club grip can provide matching graphics and alignment markings of the reversible golf club grip such that the graphics or markings can be identical when the grip is in either a right-handed or left-handed orientation. As described above, a reversible golf club grip can incorporate matching fore and aft panels (e.g., front surface 242 and rear surface 244) that are substantially flat and identical to one another (e.g., in all aspects of geometry); with matching radii sides and a center cavity that is an axial bore. Furthermore, such a reversible golf club grip can include a vertical cross-sectional dimension that is greater than its horizontal cross-sectional dimension in its installed orientation.

Those skilled in the art can readily recognize that numerous variations and substitutions may be made to the reversible golf club grip, their use and configuration to achieve substantially the same results as achieved by the embodiments described herein. Accordingly, there is no intention to limit the reversible golf club grip to the disclosed exemplary forms. Many variations, modifications and alternative constructions fall within the scope and spirit of the disclosure.

While various embodiments of the present invention have been described above, it should be understood that they have been presented by way of example only, and not of limitation. Likewise, the various figures may depict an example architectural or other configuration for the invention, which is done to aid in understanding the features and functionality that can be included in the invention. The invention is not restricted to the illustrated example architectures or configurations, but can be implemented using a variety of alternative architectures and configurations. Additionally, although the invention is described above in terms of various embodiments and implementations, it should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are described and whether or not such features are presented as being a part of a described embodiment. Thus the breadth and scope of the present invention should not be limited by any of the above-described embodiments.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above.

What is claimed is:

1. A reversible golf club grip, comprising:

an elongate base member defining:

an interior channel extending from a top end portion to a bottom end portion, a substantially planar front surface and a substantially planar rear surface separated by a vertical dimension, opposing radial surfaces separated by a horizontal dimension perpendicular to the vertical dimension wherein the vertical dimension is greater than the horizontal dimension, and wherein in a cross-section of the grip the horizontal dimension has a horizontal axis and the vertical dimension has a vertical axis and the grip is symmetrical along the entire vertical axis and along the entire horizontal axis in the cross-section of the grip where the vertical dimension is greater than the horizontal dimension; and an outer wrap member circumscribing and coupled to the elongate base member.

2. The reversible golf club grip of claim 1 wherein the reversible golf grip is able to be used by both left-handed players and right-handed players after being attached to a shaft of an adjustable golf club and without being removed from the shaft.

3. The reversible golf club grip of claim 2 wherein the outer wrap member includes alignment markings, the outer wrap member being coupled to the elongate base member such that a first set of the alignment markings is viewable by a left-handed player and a second set of the alignment markings is viewable by a right-handed player.

4. The reversible golf club grip of claim 1 wherein the horizontal dimension is associated with radii of the opposing radial surfaces wherein each of the opposing radial surfaces extends between an edge of the substantially planar front surface and an edge of the substantially planar rear surface.

5. The reversible golf club grip of claim 4 wherein the radii include a first radius associated with a first curved surface of the opposing radial surfaces and a second radius associated with a second curved surface of the opposing radial surfaces, the first radius being equal to the second radius.

6. The reversible golf club grip of claim 1 wherein the bottom end portion defines an opening for receiving a golf club shaft.

7. The reversible golf club grip of claim 1 wherein the substantially planar front surface defines a fore panel and the substantially planar rear surface defines an aft panel identical and parallel to the fore panel.

8. The reversible golf club grip of claim 1 wherein the bottom end portion defines an opening for receiving a shaft of a golf putter.

9. A reversible golf club grip, comprising:

an elongate base member defining:

an interior channel extending from a top end portion to a bottom end portion, a substantially planar front surface and a substantially planar rear surface separated by a vertical dimension, opposing curved surfaces separated by a horizontal dimension perpendicular to the vertical dimension wherein the vertical dimension is greater than the horizontal dimension, and wherein in a cross-section of the grip the horizontal dimension has a horizontal axis and the vertical dimension has a vertical axis and the grip is symmetrical along the entire vertical axis and along the entire horizontal axis in the cross-section of the grip where the vertical dimension is greater than the horizontal dimension, wherein the bottom end portion defines an opening for receiving a shaft of a golf club.

10. The reversible golf club grip of claim 9 further including an outer wrap member circumscribing and coupled to the elongate base member.

11. The reversible golf club grip of claim 9 wherein the horizontal dimension is associated with radii of the curved surfaces wherein each of the opposing curved surfaces extends between an edge of the substantially planar front surface and an edge of the substantially planar rear surface.

12. The reversible golf club grip of claim 11 wherein the radii include a first radius associated with a first curved surface of the opposing curved surfaces and a second radius associated with a second curved surface of the opposing curved surfaces, the first radius being equal to the second radius.

13. The reversible golf club grip of claim 9 wherein the substantially planar front surface defines a fore panel and the substantially planar rear surface defines an aft panel identical and parallel to the fore panel.

* * * * *